US007352291B2

(12) United States Patent
Reumerman

(10) Patent No.: US 7,352,291 B2
(45) Date of Patent: Apr. 1, 2008

(54) METHOD OF RECEIVING MESSAGES TRANSMITTED FROM VEHICLE TO VEHICLE

(75) Inventor: Hans-Jürgen Reumerman, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 214 days.

(21) Appl. No.: 10/567,274

(22) PCT Filed: Aug. 9, 2004

(86) PCT No.: PCT/IB2004/051430

§ 371 (c)(1),
(2), (4) Date: Feb. 6, 2006

(87) PCT Pub. No.: WO2005/017854

PCT Pub. Date: Feb. 24, 2005

(65) Prior Publication Data

US 2006/0232439 A1 Oct. 19, 2006

(30) Foreign Application Priority Data

Aug. 19, 2003 (EP) ..... 03102588

(51) Int. Cl.
*G08G 1/09* (2006.01)

(52) U.S. Cl. ..... 340/905; 340/995.12; 340/995.13; 701/1; 701/117

(58) Field of Classification Search ..... 340/905, 340/904, 902, 933, 934, 988, 995.12, 995.13; 701/1, 117, 118, 119, 200
See application file for complete search history.

(56) References Cited

U.S. PATENT DOCUMENTS

| | | | | |
|---|---|---|---|---|
| 4,136,683 | A | 1/1979 | Gordon | |
| 5,428,544 | A | 6/1995 | Shyu | |
| 6,081,200 | A | 6/2000 | Park | |
| 7,188,025 | B2 * | 3/2007 | Hudson, Jr. | 701/117 |
| 7,254,480 | B2 * | 8/2007 | Watanabe | 701/200 |
| 7,272,357 | B2 * | 9/2007 | Nishiga et al. | 455/11.1 |
| 2002/0094825 | A1 | 7/2002 | Endo et al. | |
| 2002/0198632 | A1 | 12/2002 | Breed et al. | |
| 2007/0088464 | A1 * | 4/2007 | Coates | 701/1 |

FOREIGN PATENT DOCUMENTS

| | | | |
|---|---|---|---|
| EP | 0095124 | A1 | 5/1983 |
| EP | 0692775 | A1 | 1/1996 |
| EP | 1304542 | A2 | 4/2003 |

OTHER PUBLICATIONS

J. Cuellar et al; "Geopriv Requirements", Network Working Group, Feb. 2004.

* cited by examiner

*Primary Examiner*—Toan N. Pham

(57) ABSTRACT

A method of receiving messages which are transmitted from vehicle to vehicle and contain information relating to traffic is characterized in that information from received messages is only accepted when a number of identical items of information are received, wherein the number is greater in heavy traffic than in light traffic.

11 Claims, 1 Drawing Sheet

METHOD OF RECEIVING MESSAGES TRANSMITTED FROM VEHICLE TO VEHICLE

Figure 1:
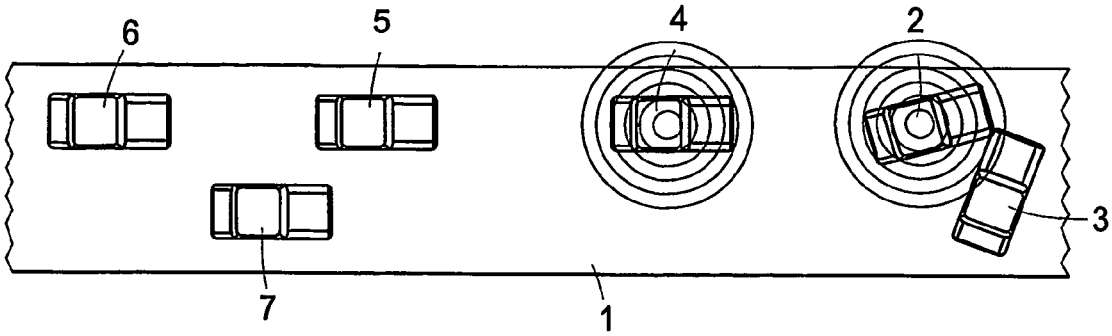

The invention relates to a method of receiving messages transmitted from vehicle to vehicle and containing information relating to traffic.

The transmission of messages according to the precharacterizing clause, also known as car-to-car communication, is known for example from US 20020198632 A and allows vehicles to cooperate with the assistance of sensors in order to avoid accidents. Thus, for example, subsequent vehicles may be made aware of a traffic jam or an accident. Likewise, at crossroads and junctions the traffic may be made aware of vehicles with priority (police, fire service). The information obtained by way of this communication may only be used to provide the driver with information or to bring about intervention in the vehicle control system.

With such communication systems, data security is essential. In particular, falsified messages must not be allowed to cause accidents. Various methods of ensuring such security have become known, for example Junko Yoshida: Suppliers to add security features to wireless comm chips; http://www.eetimes.com/story/OEG20021121S0042; EE Times Nov. 22, 2002;

Magda El Zarki et al.: Security Issues in a Future Vehicular Network; Department of Information and Computer Science, University of California, Irvine; presented at European Wireless 2002 conference, Florence, Italy; February 2002;

A. Eskandarian et al.: Assessment of Vulnerabilities in In-Vehicle Intelligent Transportation Systems; Center for intelligent Systems Research at George Washington University, Ashburn, Va. http://www.cisr.gwu.edu/research/security details.html These methods apply cryptographic methods, which, given the large number of network nodes (vehicles) and the limited computing capacity in vehicles, cannot be performed with the necessary speed and reliability.

It is additionally known from I. Chisalita, N. Shahmehri "A novel architecture for supporting vehicular communication" IEEE 56th Vehicular Technology Conference, Vancouver, Canada, 24-28 Sep. 2002 to filter vehicle-to-vehicle messages with regard to relevance and as a function of traffic conditions. However, data security aspects are not addressed therein.

The method according to the invention increases security against falsification of messages or the introduction of false messages, in that information from received messages is only accepted when a number of identical items of information are received, wherein the number is greater in heavy traffic than in light traffic.

The method according to the invention exploits the redundancy which is present in those traffic situations in which vehicle-to-vehicle communication is particularly important. The method according to the invention is suitable for other situations too, however, for example if a vehicle uses an extremely infrequently used road at night. Application of the method according to the invention does not exclude the simultaneous application of cryptographic methods.

Various designs of the method according to the invention are directed towards the detection of traffic density. Thus, for example, it is possible for the traffic density to be measured by sensors on the vehicle in which the messages are received. In particular, the sensors may in this regard determine the number of transmitting vehicles in the receiving range or the number of vehicles traveling past.

Another possible way of determining traffic density consists in obtaining the traffic density from a stationary information system. A suitable information system for this purpose is for example the DAB (=digital audio broadcasting) TMC (=traffic message channel).

A further embodiment of the method according to the invention is characterized in that the number depends on further variables. These further variables may be taken from a digital road map. However, the user's individual data stored in an appropriate database are also suitable. In addition, the further variables may include at least weather and road condition information.

An advantageous design of the method according to the invention consists in the fact that the number depends on weighting of the respective information. For the purpose of weighting, information about the road network and/or the user's individual data and/or measured data may be used, which are obtained by means of vehicle sensors.

The method according to the invention may additionally be characterized in that the information which is accepted is displayed and/or brings about intervention in the control system of the vehicle.

In the context of the present invention, the term "message" includes a range of information, for example also an indication of the transmitting vehicle and of the location of the transmitting vehicle. The information tested for redundancy in the context of the invention constitutes part of these messages and is limited only to the event to be reported in each case, for example "road closed in . . . km". If, therefore, in the context of the method according to the invention messages are only accepted where a number of identical items of information are received, the definite intention is that these identical items of information should be contained in different messages which may originate from different vehicles.

Figure 2:
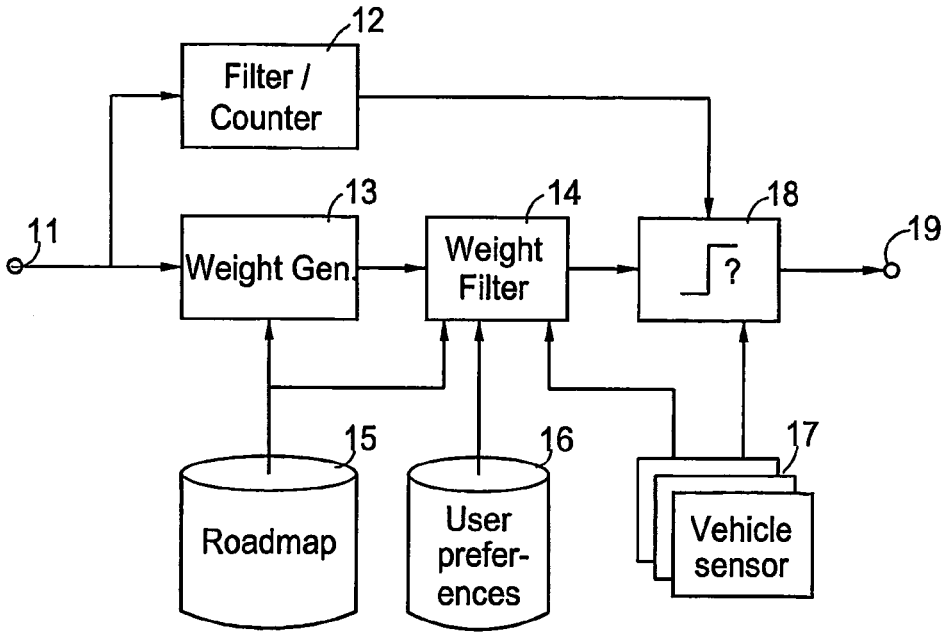

The invention will be further described with reference to examples of embodiment shown in the drawings to which, however the invention is not restricted. In the Figures:

FIG. 1 shows vehicles on a road to illustrate both known vehicle-to-vehicle communication and such communication according to the invention and FIG. 2 is a block diagram of an example of embodiment.

FIG. 1 shows a road 1, on which two vehicles 2, 3 have collided and are thus blocking the road. It should be assumed that at least one of the vehicles 2, 3 is intact to the extent that the transmitter and the associated sensors are functional. Information about this accident is then emitted by this vehicle. It should additionally be assumed that the vehicle 4 brakes sharply and likewise comes to a standstill and emits a corresponding message. Vehicles 5, 6, 7 receive these messages. In each case a warning is output to the driver.

With the known method, such a message can be imitated, such that troublemakers could cause the drivers of vehicles 5, 6, 7 to perform emergency braking. With the method according to the invention, in the example given the warnings in the vehicles 5, 6, 7 would be triggered only on receipt of messages from vehicles 2 and 4. Given the large number of vehicles which travel on one and the same road in heavy traffic, in practice many more identical items of information are required, so making it much more difficult to generate erroneous messages, whether deliberately or not.

The example of embodiment according to FIG. 2 is illustrated as a block diagram. However, this does not mean that the method according to the invention is restricted to being implemented by means of individual circuits corresponding to the blocks. Rather, the method according to the invention may be implemented particularly advantageously by means of large-scale integrated circuits. In this regard, microprocessors may be used which, with suitable programming, perform the processing steps illustrated in the block diagrams.

The messages received by a suitable receiver are fed at 11 to the device illustrated in FIG. 2 and arrive at a filter/counter 12 and a weighting generator 13. In the filter/counter 12, the number of messages with in each case identical content are counted separately. In the weighting generator 13, the priority transmitted with the message and possible responses in the case of automatic intervention in the vehicle control system are evaluated. The weighting generator 13 and a subsequent weighting filter 14 receive data from a database 15 with a digital road map. In this way it is possible, for example, for messages which relate to the opposite carriageway of an expressway or to an additional road running parallel to be provided with low weighting.

A further database 16 contains the user's individual data and preferences, which the user may in each case adjust to his/her requirements. The database 16 for example additionally contains data for vehicle owner identification and further data necessary for encryption and authentication. These are likewise applied in the weighting filter 14 for weighting the messages. Finally, current measured data from vehicle sensors 17 are also fed to the weighting filter 14. For example, a message which is weighted very heavily when the vehicle is moving may be relatively unimportant if the vehicle is stationary. If a number of identical items of information are stored in the filter/counter 12, the respective information takes on a corresponding degree of trustworthiness. By performing a comparison at 18 with the output data of the weighting filter 14, it is finally decided whether to accept the information and output it at 19, for example to a display unit or to a vehicle control system.

The invention claimed is:

1. A method of receiving messages transmitted from vehicle to vehicle and containing information relating to traffic, characterized in that information from received messages is only accepted when a number of identical items of information are received, wherein the number is greater in heavy traffic than in light traffic.

2. A method as claimed in claim 1, characterized in that the traffic density is measured by sensors on the vehicle in which the messages are received.

3. A method as claimed in claim 1, characterized in that the traffic density is obtained from a stationary information system.

4. A method as claimed in claim 1, characterized in that the number depends on further variables.

5. A method as claimed in claim 4, characterized in that the further variables include at least weather and road condition information.

6. A method as claimed in claim 1, characterized in that the number depends on weighting of the respective information.

7. A method as claimed in claim 6, characterized in that information about the road network is used for weighting.

8. A method as claimed in claim 6, characterized in that the user's individual data are used for weighting.

9. A method as claimed in claim 6, characterized in that measured data are used for weighting, which are obtained by means of vehicle sensors.

10. A method as claimed in claim 1, characterized in that the information which is accepted is displayed.

11. A method as claimed in claim 1, characterized in that the information which is accepted brings about intervention in the vehicle control system.

* * * * *